United States Patent [19]

Dippel et al.

[11] Patent Number: 4,534,893

[45] Date of Patent: Aug. 13, 1985

[54] METHOD FOR SOLIDIFYING RADIOACTIVE WASTES

[75] Inventors: Theodor Dippel, Eggenstein-Leop.; Andreas Loida, Stutensee, both of Fed. Rep. of Germany

[73] Assignee: Kernforschungszentrum Karlsruhe GmbH, Fed. Rep. of Germany

[21] Appl. No.: 432,407

[22] Filed: Sep. 30, 1982

[30] Foreign Application Priority Data

Apr. 17, 1982 [DE] Fed. Rep. of Germany ..... 3214242

[51] Int. Cl.[3] ..... G21F 9/16

[52] U.S. Cl. ..... 252/629; 252/628; 252/633; 264/0.5

[58] Field of Search ..... 252/629, 628, 633; 264/0.5; 65/18.1, 30.1

[56] References Cited

U.S. PATENT DOCUMENTS

| | | | |
|---|---|---|---|
| 3,000,072 | 9/1961 | Evans | 252/629 |
| 4,172,807 | 10/1979 | Larker | 252/629 |
| 4,297,304 | 10/1981 | Scheffler et al. | 264/0.5 |
| 4,312,774 | 1/1982 | Macedo et al. | 252/629 |
| 4,354,954 | 10/1982 | Köster | 252/633 |
| 4,362,659 | 12/1982 | Macedo et al. | 252/629 |
| 4,376,070 | 3/1983 | Pope et al. | 252/629 |

FOREIGN PATENT DOCUMENTS

| | | | |
|---|---|---|---|
| 2611689 | 9/1977 | Fed. Rep. of Germany | 252/629 |
| 2945006 | 5/1981 | Fed. Rep. of Germany . | |
| 133499 | 9/1977 | Japan | 252/629 |

OTHER PUBLICATIONS

Deutsche Industrienorm DIN Nr. 12111, 2 pages.

Gonzalez-Oliver et al., 1981, Glass Ceramic Formation and the Preparation of Glasses by the Sol-Gel Method, Glass: 304-307.

Yoldas, B., 1977, Preparation of Glasses and Ceramics from Metal-Organic Compounds, Journal of Materials Science, 12: 1203-1208.

Yoldas, B., 1979, Monolithic Glass Formation by Chemical Polymerization, Journal of Materials Science, 14: 1843-1849.

*Primary Examiner*—Ben R. Padgett

*Assistant Examiner*—Howard J. Locker

*Attorney, Agent, or Firm*—Sughrue, Mion, Zinn, Macpeak and Seas

[57] ABSTRACT

A process for solidifying radioactive wastes by producing compact blocks which are to be disposed in transporting or permanent storage containers. The compact blocks are produced from prefabricated ceramic tablets which contain radioactive substances and a matrix which continuously surrounds these ceramic tablets and is solid in its final state. Glass powder or a mixture of oxidic non-clay minerals or a mixture of both is used as the matrix material. The ceramic tablets and the matrix material are filled into the container and are compressed. The resulting compressed mixture is heated to a temperature in the range from 1423° K. to 1623° K., is held at this temperate range for one to three hours, and is finally gradually cooled to room temperature.

10 Claims, No Drawings

METHOD FOR SOLIDIFYING RADIOACTIVE WASTES

BACKGROUND OF THE INVENTION

The present invention relates to a method for solidifying radioactive wastes, and more particularly to a method for improving the long-term storage characteristics of solidified radioactive wastes comprising compact blocks which are to be disposed in transporting or final storage containers. The compact blocks comprise prefabricated ceramic tablets containing radioactive substances and an inactive matrix which continuously surrounds these tablets and is solid in its final state.

Radioactive wastes must be conditioned for permanent storage, i.e. they must be converted with the aid of matrix materials into solidified products. Such solidified products must have a high resistance to leaching of the radioactive substances by aqueous solutions.

For waste concentrates containing medium and highly radioactive wastes and/or actinides, or for fine-grained solid wastes which are present as suspensions in water or acids or for muds, ceramic matrix materials have been used, among others, to form the solidified products. The radioactive wastes are mixed with these matrix materials, are shaped and sintered to form mechanically stable bodies. For reasons of workability of such ceramic materials, the tablet shape has been selected for the ceramic solidification products. In principle, radioactive wastes that have been conditioned in this manner can be stored in suitable containers in a permanent storage facility.

There do exist, however, some considerable drawbacks with the tablet shaped solidification products. Thus, if the transporting or final storage container is damaged, the tablets may be scattered about. The danger of contamination is then augmented considerably.

Moreover, the bulk of such tablets constitutes a very large surface area. In the case of the entry of liquids, for example, water or aqueous salt solutions, the leachings of radioactive substances per unit time is relatively high.

Further, heat dissipation from the bulk tablet fill is limited.

These drawbacks can be overcome if bulk fills of ceramic tablets, whose individual volume is in the milliliter range, are solidified with the aid of a filler or binder into compact and mechanically stable blocks. The volume of these blocks is the liter range. Such fillers or binders will hereinafter be called the continuous matrix.

DE-PS No. 2,726,087 and corresponding U.S. Pat. No. 4,297,304 disclose a method for solidifying such radioactive wastes. In particular, these documents disclose a method for solidifying high and medium radioactivity and/or actinide containing aqueous waste concentrates or fine-grained solid wastes suspended in water for final noncontaminating storage in which the waste concentrates or the suspensions are subjected together with absorbing and/or hydraulically binding inorganic material, to a ceramic firing process so as to produce a solid sintered body.

The method comprises a plurality of steps, including (a) treating the waste concentrates or suspensions by evaporation, to form an evaporate having a water content in the range between 40 and 80 percent by weight and a solid content whose metal ion and/or metal oxide concentration lies between 10 and 30 percent by weight of the evaporate being formed, and adjusting the pH of the evaporate to between 5 and 10; (b) kneading the evaporate obtained from step (a) with a clay-like substance containing a small quantity of cement, or with such a clay-like substance or mixture of a clay-like substance with a small quantity of cement containing an additive for suppressing the volatility of alkali metals or alkaline earth metals which may be present in the evaporate and/or an additive for suppressing the volatility of any decomposable anions which may be present in the evaporate selected from sulfate, phosphate, molybdate and uranate ions, at a weight ratio range of evaporate to clay-like substance of 1:1 to 2:1, the clay-like substance being at least one substance selected from pottery clays, stoneware clays, porcelain clay mixtures and kaolin; (c) producing molded bodies from the kneaded mass obtained in step (b); (d) heat treating the molded bodies, including drying at temperatures between room temperature and 150° C., calcining at temperatures up to 800° C., and subsequently firing at temperatures between 800° and 1400° C. to form practically undissolved mineral phases; and (e) enclosing the molded bodies containing the fired mineral phases on all sides in a dense, continuous ceramic or metallic matrix.

The molded bodies of step (d) can be comminuted to a grain size range of about 1 to 10 mm, and thus be in the form of small particles or chips before being enclosed in the matrix of step (e).

The continuous matrix can be a fired ceramic produced from at least one clay substance and at least one cement. It has been found, however, that if a continuous ceramic matrix is used produced from at least one clay-like substance, e.g. from the group including pottery clays, porcelain clay mixtures or kaolin, and cement, and particularly if this mass has been processed into a fired ceramic, the solidified product does not have the desired properties. No clay-like material, with or without the addition of cement, has been found thus far for use as a continuous matrix which, in its sintered state, has a coefficient of thermal expansion which is at least very similar to that of the ceramic tablets and which shrinks uniformly and tightly onto the ceramic tablets during firing so that in the past solidified blocks were obtained which were penetrated by extensive cracks. The cracks permitted the access of liquids into the interior. Moreover, the mechanical stability of such blocks was limited.

These drawbacks could also not always be overcome by the use of a hot pressing technique. In contrast to mixtures of particulate bodies which can be optimally compressed and sintered, there are limited possibilities for compressing mixtures of sinterable, clay-like or ceramic powders. The compression limit is reached when the ceramic tablets contact one another and support themselves on one another. Beginning with this state, the pressure no longer acts on the ceramic powder disposed in the interstices. Sintering then takes place practically without pressure, i.e. compression occurs only by the shrinkage caused by the sintering process. Thus, the same or similar results can be expected as in the above-mentioned process of DE-PS No. 2726087 and U.S. Pat. No. 4,297,304 which is a pressure-free sintering process.

If it is attempted to effect compression beyond the stated limits, this unavoidably results in destruction of the ceramic tablets. At the customary sintering temperatures, the ceramic matrix material does not flow so plastically that it is able to cover the resulting fragments on all sides, and accordingly the pressure surfaces remain practically open. One advantage of embedding the ceramic tablets in a matrix, namely the reduction of the surface area accessible to leaching when the transporting or permanent storage container is damaged, is thus eliminated.

A more extensive compression than described above without the danger of destruction of the ceramic tablets can be realized if it is assured, by a high mixing ratio of ceramic powder to ceramic tablet, that in the compressed state there will always be matrix material between the ceramic tablets. Independently of whether this state can be realized with sufficient reliability under conditions applicable to working with highly radioactive substances, there exists the drawback that the volume of the container holding the block with the solidified tablets cannot be utilized optimally with respect to the tablets, since the matrix material enforces a certain "spacing" of the tablets. This drawback is connected with the fact that unavoidably expensive permanent storage volume must be occupied with inactive substances.

SUMMARY OF THE PRESENT INVENTION

It is an object of the present invention to provide a method for solidifying ceramic tablets containing radioactive substances by means of a continuous matrix material to form compact and mechanically stable solidified blocks with few pores, in which the resulting compact blocks (waste/matrix end products) are radiation resistant, heat resistant and resistant to leaching out of the incorporated radionuclides, as well as free of cracks, particularly at the interfaces between the ceramic tablets containing the radioactive substances and the continuous matrix.

Another object of the present invention is to provide such a method which makes it possible to produce solidified products in which the ceramic tablets, even if they come into direct contact with one another, remain undamaged, so that the process of the present invention avoids the danger which is inherent in the products made according to the prior art, namely, that the tablets which during mixing come into contact with the continuous matrix are damaged, i.e. broken or fragmented in the subsequent pressing and sintering step.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for solidifying radioactive substances by producing compact blocks which are to be disposed in transporting or permanent storage containers, the compact blocks being produced from prefabricated ceramic tablets which contain radioactive substances and an inactive matrix material which continuously surrounds the tablets and is solid in its final state, comprising: providing as the matrix material at least one material selected from a glass powder and a mixture of oxidic non-clay minerals; filling the ceramic tablets and the matrix material into a container, compressing the ceramic tablets and matrix material to form a compressed mixture; heating the thus obtained compressed mixture to a temperature in the range from 1423° K. to 1623° K., maintaining the compressed mixture in this temperature range for one to three hours, and finally cooling the compressed mixture gradually to room temperature.

In one preferred embodiment of the present invention, when the matrix material is a glass powder, the powder is an alkali borosilicate glass having the highest chemical resistance (defined in Deutsche Industrienorm DIN Nr. 12111) and a transformation range between 840° K. and 1370° K., as well as a particle size distribution of 50% by weight at $<10$ microns and 50% by weight $\geqq 10$ micron, but 99% by weight $<63$ microns.

In another preferred embodiment of the the present invention, when the matrix material is an oxidic mineral matrix, the oxidic mineral matrix is comprised of a mixture of $SiO_2$, preferably, in an amount of 50 to 70% by weight, $Al_2O_3$, preferably in an amount of 15 to 35% by weight, and MgO, preferably in an amount of 10 to 30% by weight.

It is to be understood that both the foregoing general description and the following detailed description are exemplary, but are not restrictive of the invention.

DETAILED DESCRIPTION OF THE PRESENT INVENTION

In accordance with the present invention, ceramic tablets and a matrix material are filled into a container. The ceramic tablets which are employed in the present invention contain radioactive waste, and can be those whose have been produced in the prior art. The radioactive wastes in the ceramic tablet can be, for example, medium activity wastes, high activity wastes, actinide concentrates, or fine grained solid wastes such as ashes and residues from the combustion of organic radioactive wastes. The ceramic tablets which are mixed with the matrix material can contain only one of the above radioactive wastes, or each tablet can contain more than one of the above radioactive wastes. Moreover, the ceramic tablets can comprise a mixture of tablets, with the tablets containing different individual radioactive wastes of the above type. Thus, for example, some tablets in the mixture of tablets can contain only high activity wastes and other tablets in the mixture can only contain only medium activity wastes.

The ceramic tablets which can be solidified into compact blocks in accordance with the present invention can have any one of a number of compositions. For example, the ceramic tablet can comprise $Al_2O_3$ in an amount of 57.6 to 69.6% by weight, $SiO_2$ in an amount of 10.4 to 22.4% by weight, and radioactive waste in amount of 20% by weight, and having preferably a ratio of $Al_2O_3$: $(Al_2O_3+SiO_2)$ of 0.72 to 0.87.

Another suitable ceramic tablet can comprise kaolin in an amount of 55.0 to 70.0% by weight, bentonite in an amount of 15.0 to 25% by weight, and radioactive waste in amount of 5 to 25% by weight. A preferred ceramic tablet of this type comprises 60% kaolin, 20% bentonite, and 20% radioactive waste, all by weight. The type of bentonite preferably is a bentonite from the region of Klärlich.

Still another suitable ceramic tablet can comprise feldspar in an amount of 20% by weight, quartz in an amount of 20% by weight, kaolin in an amount of 40% by weight, and radioactive waste in an amount of 20% by weight.

The matrix material which is employed in the practice of the present invention can comprise a glass powder or can comprise a mixture of oxidic non-clay minerals. Non-clay minerals are understood to mean non-clay and non-clay-like minerals.

When the matrix material is a glass powder, the glass powder preferably is an alkali borosilicate glass having the highest chemical resistance and a transformation range between 840° K. and 1370° K., as well as a particle size distribution of 50% by weight at <10 microns and 50% by weight ≧10 micron, but 99% by weight <63 microns.

An alkali borosilicate glass made by Schott (Germany) which can be purchased under the type number 2877 has been found to be suitable for use in the present invention. Its approximate composition is: more than 70% by weight $SiO_2$, a maximum amount 10% by weight $B_2O_3$, a maximum amount 10% by weight $Al_2O_3$, and a maximum amount 10% by weight $Na_2O$.

When the matrix material is an oxidic mineral matrix, the oxidic mineral matrix preferably is comprised of a mixture of $SiO_2$, preferably, in an amount of 50 to 70% by weight, $Al_2O_3$, preferably in an amount of 15 to 35% by weight, and MgO, preferably in an amount of 10 to 30% by weight.

Most preferably, the mineral matrix composition will be 51.4% by weight $SiO_2$, 34.8% by weight $Al_2O_3$, and 13.8% by weight MgO. This corresponds to the aluminosilicate mineral cordiorite. To improve the sinterability, other silicate materials, such as, for example, native potassium aluminum silicate, can be added in quantities of 5 to 20% by weight.

In accordance with the invention, the ceramic tablets and matrix material are filled into a container, and the ceramic tablets and matrix material are compressed to form a compressed mixture in the container. The ceramic tablets and the matrix material can be introduced into the container, either individually in succession, or together in an intimate mixture, or individually simultaneously. The ceramic tablets and the matrix material are compressed during or after the respective filling in of the tablets or matrix particles, respectively. The compression takes place by means of vibration or shaking, or in the case where an intimate mixture is filled in, the compression can occur by a subsequent pressing of the mixture. When compressing by vibration, the compression by vibration preferably takes place in a vacuum in the range between 1 mbar to 50 mbar.

The matrix materials usable in the process according to the present invention for production of compact blocks are soluble in water and brine only to an extremely slight degree. The matrix materials employed in the present invention enclose the individual tablet on all sides. Direct contact between the tablets is then nondamaging, compared to the corresponding state in solidified blocks produced according to one of the prior art processes as for example, described in U.S. Pat. No. 4,297,304, if the points of contact (present invention) are enclosed by the continuous matrix as completely as permitted by them.

In accordance with the invention, the compressed mixture of ceramic tablets and matrix material is heated to a temperature in the range of 1423° to 1623° K., the compressed mixture is held in this temperature range for one to three hours, and then gradually cooled to room temperature.

When glass powders are used, the ceramic tablets are heated together with the glass powder in a container, preferably in the form of a crucible to, for example, 1473° K. and are kept at this temperature for two hours. The usable temperatures in this embodiment of the process are in a range between about 1423° K. and 1523° K. Then the tablets are slowly cooled to room temperature, at a cooling rate of, for example, about 0.5° C./min. As a result of the heating, the glass powder melts into a uniform glass flow which, in its solidified state, encases the tablets and connects them to one another.

The quality of the compact block depends on the quality of the mixing of the tablets and glass powder and on the type of glass employed. There are a number of preferred methods for mixing the tablets and glass powder which assure the required quality of the mixture.

In the first preferred method for mixing the tablets and glass powder, the tablets first are filled into the crucible, the fill is then compressed by means of vibration, and thereafter, the freely flowing glass powder is filled in under vibration. Alternatively, the compression can occur during the filling of the tablets as well as during the subsequent filling of the glass powder.

In a second preferred method for mixing the tablets and glass powder, the tablets and glass powder are mixed outside the crucible, the mixture is then filled into the crucible together, and the fill is then compressed by vibration or pressing. Compressing by vibration can occur during the filling of the mixture into the crucible.

In a third preferred method for mixing the tablets and glass powder, the tablets and glass powder are separately and uniformly (simultaneously) filled in the crucible under vibration.

The vibrating employed in the mixing of the tablets and glass powder can take place in a vacuum, preferably in a range from 1 mbar to 50 mbar.

In all of the above cases, the ceramic tablets, which are specifically heavier than the bulk density of the glass powder, are compressed in such a manner that the container volume is fully utilized with respect to the ceramic tablets.

The mixture thus introduced into the crucible can be coated with glass powder before or during the melting of the glass powder. In this way, a cover layer of glass is formed which is free of tablets.

The glass employed preferably is an alkali borosilicate glass having the highest chemical resistance. Its transformation range lies from 840° K. to 1370° K. Its viscosity preferably is $10^4$.Pa sec at 1373° K. Ceramic tablets containing the above-mentioned radioactive wastes individually or in a mixture, or a mixture of tablets containing individual radioactive wastes can be solidified with such a glass.

Experiments with other borosilicate glasses, as they have been used in the past, for example, borosilicate glasses for the solidification of highly radioactive, liquid wastes, or, for example, so-called solder glasses, indicate that these types of glass are not suited as matrix materials for use in the present invention. Typical composition of a borosilicate glass for solidification of high level liquid waste: see attachment 1. Blocks made of the borosilicate glasses which in the past have been used for the solidification of highly radioactive liquid wastes cannot be tempered without cracks. The so-called solder glasses tend to react with the ceramic tablets.

Ceramic tablets having a lower density than the glass melt move to the top in the glass melt. Demixing of tablets and glass melts can be prevented by a depressor which dips under the surface of the glass. Suitable materials for the melting crucible and the depressors are primarily oxidic and other ceramics, under certain circumstances also graphite. The melting crucibles may also be designed as molds from which the block can be removed. If necessary, the block may be changed in this way into a container suitable for intermediate or permenant storage

| | |
|---|---|
| $SiO_2$ | 56.7 percent by weight |
| $TiO_2$ | 4.6 percent by weight |
| $Al_2O_3$ | 2.6 percent by weight |
| $B_2O_3$ | 12.4 percent by weight |
| MgO | 2.1 percent by weight |
| CaO | 4.1 percent by weight |
| $Na_2O$ | 17.5 percent by weight |

Reference:
W. Guber et al Preparation and Characterization of an Improved Borosilicate Glass for the Solidification of High Level Liquid Radioactive Waste (HLW).
Part I: Investigation of 25 Borosilicate Glasses Product for the Selection of an Optimized Matrix KfK 2721e, 1982 (to be published)
Note:
This borosilicate glass distinguishes completely from the Schott-glass Nr. 2877. It cannot be used for this invention.

The solder glass used was Schott glass Nr. 8272. This is a lead borosilicate glass. The composition is not available.

As discussed above, instead of a glass matrix, a compact block can also be produced from an oxidic mineral matrix. This can be accomplished by employing a mineral matrix which preferably is a mixture of $SiO_2$, preferably in an amount of 50 to 70%, $Al_2O_3$, preferably in an amount of 15 to 35%, and MgO, preferably in an amount of 10 to 30%. Most preferably, the mineral matrix composition will be 51.4% by weight $SiO_2$, 34.8% by weight $Al_2O_3$, and 13.8% by weight MgO. This corresponds to the aluminosilicate mineral cordierite. To improve the sinterability, other silicate materials, such as, for example, native potassium aluminum silicate, can be added in quantities of 5 to 20% by weight (refers to the amount of cordierite).

The powder characteristics of the starting substances used to form the mineral matrix are selected so that they can be sintered with the ceramic tablets without binders preferably at about 1573° K. For this purpose, the mixture of the above-mentioned oxides and the ceramic tablets preferably is introduced into the sintering crucible in the same manner as described above with respect to the borosilicate glass. The sintered bodies are free of pores and cracks. Usable sintering temperatures when employing a mineral matrix are in a range between about 1523° K. and 1623° K.

In general, the ceramic tablets and the oxidic mineral material can be introduced into the container, either individually in succession, or together in an intimate mixture, or individually simultaneously. The ceramic tablets and the oxidic matrix material are compressed during or after the respective filling in of the tablets or matrix particles, respectively. The compression takes place by means of vibration or shaking, or in the case where an intimate mixture is filled in, the compression can occur by a subsequent pressing of the mixture. Compaction by vibration or pressing is carried out according to the state of the art. When compressing by vibration, the compression by vibration preferably takes place in a vacuum, preferably in the range between 1 mbar to 50 mbar.

In a first preferred method for mixing the tablets and oxidic mineral material, the tablets first are filled into the container, in the form of a crucible, the fill is then compressed by means of vibration, and thereafter, the freely flowing oxidic mineral material is filled in under vibration. Alternatively, the compression by vibration can occur during the filling of the tablets as well as during the subsequent filling of the oxidic mineral material.

In a second preferred method for mixing the tablets and oxidic mineral material, the tablets and oxidic mineral material are mixed outside the crucible, the mixture is then filled into the crucible together, and the fill is then compressed by vibration or pressing. Compressing by vibration can occur during the filling of the mixture into the crucible.

In a third preferred method for mixing the tablets and oxidic mineral material, the tablets and oxidic mineral material are separately and uniformly (simultaneously) filled in the crucible under vibration.

In all of the above cases, the ceramic tablets, which are specifically heavier than the bulk density of the oxidic mineral material, are compressed in such a manner that the container volume is fully utilized with respect to the ceramic tablets.

The mixture thus introduced into the crucible can be coated with oxidic mineral material before or during the sintering of the oxidic mineral material. In this way, a cover layer of oxidic mineral material is formed which is free of tablets.

The matrix material, whether the glass or oxidic mineral material, can be specially pretreated and processed before being mixed with the tablets, e.g. premixed, reground, granulated and/or heat treated so as to optimize its processability.

The volume ratio of tablets to continuous matrix is advantageously about 0.6 with a glass matrix and about 0.5 with an oxidic mineral mineral matrix (finished product).

The present invention provides numerous advantages. Thus, one advantage of the process of the present invention is that instead of a loose fill of ceramic tablets containing the above-mentioned radioactive wastes, compact blocks are transported or put into permanent storage. This precludes scattering of the tablets if the transporting or storage containers are damaged.

Another advantage of the process of the present invention is that the ceramic tablets containing the above-mentioned radioactive wastes are coated with a glass or mineral layer that is almost completely free of activity. This prevents, in the short run, the attack of aqueous solutions on the radioactive solidified product in the case of malfunction, and in the long run, such attack is delayed considerably.

A further advantage of the process of the present invention is that in the case of damage to a block, only the faces of the ceramic tablets exposed at the point of the break are subjected to the attack of aqueous solutions, instead of the entire tablet surface area in the case of bulk tablets.

Moreover, with the selected type of filling, the container volume is optimally utilized with respect to the ceramic tablets.

Additionally, the heat dissipation from the compact blocks is increased by the matrix material.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

This example illustrates the use of a glass matrix in forming a compact block in accordance with the present invention.

Approximately 120 ceramic tablets containing 20% by weight feed clarification sludge, with each tablet having a volume of about 4 ml, were filled together with glass powder (Schott No. 2877) into a vibrating ceramic crucible having a volume of about 1.2 liters. The volume of the glass powder was about 0,4 liters, tap density of the glass powder about 1,02 g/ml. Pellets and matrix material were filled from different sources. The thus prepared crucible was placed into a sintering furnace and heated in three hours to 1473° K. After a holding time of about 1 hour at 1473° K., glass powder was replenished to fill the resulting cavities. Then, the temperature was increased to 1503° K. for about 0.5 h. Thereafter, the crucible was cooled to room temperature in the furnace at about 0.5° C./minute.

A compact block was thus obtained which was practically free of cavities and cracks. The ceramic tablets were embedded in the glass matrix completely and unfragmented, as could be ascertained form micrographs.

EXAMPLE 2

This example illustrates the use of an oxidic mineral matrix.

A plurality of ceramic tablets containing 20% by weight feed clarification sludge, with each tablet having a tablet volume of about 2.5 ml, were filled together with the ceramic raw material, and under vibration, into a ceramic crucible having a volume of about 0.1 liters. Ratio of pellets to matrix material refers to 0.5 value (see above) The ceramic raw material had the same composition as cordierite and additionally contained an addition of 12% by weight native potassium aluminum silicate. The thus prepared crucible was placed into a sintering furnace and heated 10 1573° K. in three hours and kept at that temperature for another two hours. Then the crucible was cooled to room temperature in the furnace at approximately 1° C./minute.

A compact ceramic block was thus obtained which was free of cracks and pores. The ceramic tablets were contained in the matrix completely and unfragmented. The shrinkage of the block during sintering was about 35% by volume.

It will be understood that the above description of the present invention is susceptible to various modifications, changes and adaptations, and the same are intended to be comprehended within the meaning and range of equivalents of the appended claims.

What is claimed is:

1. Process of solidifying radioactive substances by producing compact blocks disposed in transporting or permanent storage containers, the compact blocks being produced from prefabricated ceramic tablets which contain radioactive substances and an inactive matrix which continuously surrounds the tablets and is solid in its final state, comprising (a) providing as the matrix material at least one material selected from glass powder and a mixture of oxidic non-clay minerals, the glass powder being a powder of an alkali borosilicate glass having a transformation range between 840° K. and 1370° K., and a particle size distribution of 50% by weight $<10$ microns and 50% by weight $\geqq 10$ microns, and 99% by weight being at $<63$ microns, the glass powder having a composition of more than 70% by weight $SiO_2$, a maximum amount of 10% by weight $B_2O_3$, a maximum amount of 10% by weight $Al_2O_3$, and a maximum amount of 10% by weight $Na_2O$ and the mixture of oxidic non-clay minerals comprising a mixture of 50 to 70% by weight $SiO_2$, 15 to 35% by weight $Al_2O_3$ and 10 to 35% by weight MgO;

(b) filling the ceramic tablets and the matrix material into a container, and compressing the ceramic tablets and matrix material by vibration to form a compressed mixture in the container;

(c) heating the thus obtained compressed mixture to a temperature in the range of 1423° to 1623° K., holding the compressed mixture at that temperature range for one to three hours, and finally gradually cooling to room temperature.

2. Process as defined in claim 1, wherein the matrix material comprises the mixture of oxidic non-clay minerals.

3. Process as defined in claim 1, wherein step (b) comprises first filling the ceramic tablets into the container, then compressing the fill by vibration, and thereafter filling in the matrix material under vibration.

4. Process as defined in claim 1, wherein step (b) comprises mixing the ceramic tablets and matrix material outside the container, then filling the mixture into the container, and then compressing the fill by vibration.

5. Process as defined in claim 1, wherein step (b) comprises separately and simultaneously filling the ceramic tablets and matrix material into the container under vibration.

6. Process as defined in claim 1, wherein step (b) comprises mixing the ceramic tablets and matrix material outside the container, and filling the mixture into the container while simultaneously compressing the mixture by vibration.

7. Process as defined in claim 1, wherein step (b) comprises filling the ceramic tablets and matrix material into the container in succession, while simultaneously compressing them by vibration during their successive filling.

8. Process as defined in claims 3, 5, 6, or 7, wherein the compression by vibration takes place in a vacuum in the range from 1 mbar to 50 mbar.

9. Process as defined in claim 1, wherein the matrix material is a glass powder, and the heating in step (c) in the range of 1423° K. and 1523° K. and melts the glass powder into a uniform glass flow which, in its solidified state, encases the tablets and connects them to one another.

10. Process as defined in claim 1, wherein the matrix material is an oxidic non-clay mineral, and the heating in step (c) is in the range of 1523° K. to 1623° K.

* * * * *